US010566157B2

(12) United States Patent
Jing

(10) Patent No.: US 10,566,157 B2
(45) Date of Patent: Feb. 18, 2020

(54) HEAVY CURRENT REED SWITCH CONTACT STRUCTURE

(71) Applicants: Deqiang Jing, Dongguan (CN); DONGGUAN CHUANQIANG ELECTRONIC TECHNOLOGY CO., LTD., Dongguan (CN)

(72) Inventor: Deqiang Jing, Dongguan (CN)

(73) Assignees: Deqiang Jing, Dongguan (CN); DONGGUAN CHUANQIANG ELECTRONIC TECHNOLOGY CO., LTD., Dongguan (CN)

( * ) Notice: Subject to any disclaimer, the term of this patent is extended or adjusted under 35 U.S.C. 154(b) by 137 days.

(21) Appl. No.: 15/573,835

(22) PCT Filed: Mar. 10, 2016

(86) PCT No.: PCT/CN2016/076060

§ 371 (c)(1),
(2) Date: Nov. 13, 2017

(87) PCT Pub. No.: WO2016/150305

PCT Pub. Date: Sep. 29, 2016

(65) Prior Publication Data

US 2019/0066949 A1 Feb. 28, 2019

(30) Foreign Application Priority Data

Mar. 25, 2015 (CN) ..... 2015 1 0132609

(51) Int. Cl.
*H01H 33/12* (2006.01)
*H01H 1/06* (2006.01)
(Continued)

(52) U.S. Cl.
CPC ..... *H01H 33/12* (2013.01); *H01H 1/06* (2013.01); *H01H 1/66* (2013.01); *H01H 36/0006* (2013.01)

(58) Field of Classification Search
CPC ..... H01H 33/12; H01H 1/06; H01H 1/66; H01H 36/0006
See application file for complete search history.

(56) References Cited

U.S. PATENT DOCUMENTS 3,586,809 A * 6/1971 Santi ..... H01H 1/0201 200/263
8,803,011 B2 * 8/2014 Yang ..... H01H 1/26 200/1 B
(Continued)

FOREIGN PATENT DOCUMENTS

CN 2059268 U 7/1990
CN 1529894 A 9/2004
(Continued)

*Primary Examiner* — Bernard Rojas
(74) *Attorney, Agent, or Firm* — Matthias Scholl P.C.; Matthias Scholl

(57) ABSTRACT

A heavy current reed switch contact structure comprises at least one set of elastic reed electrode (11, 12) or at least one fixed electrode (12) and an elastic reed electrode (11). The reed electrode (11, 12) is made of a conductive material. Contacts (13, 14) are arranged on opposing surfaces of mutually overlapping ends. A side of the end having the contacts is disposed with an arc discharge device (16, 162). The reed switch employs a specially designed contact structure, and the arc discharge structure device is additionally disposed on the basis of a traditional switch contact structure. As a result, the reed switch quickly transfers to the contact arc discharge structure device an instantons arc generated upon switching the switch contact, thereby easing burnout resulting from an arc on the contact surfaces of the contacts, enabling the contacts to be less prone to being adhered together, and considerably increasing a bearing current and a switching capacity of the reed switch. The heavy current reed switch contact structure has a simple structure and provides a heavy bearing current.

3 Claims, 5 Drawing Sheets

(51) Int. Cl.
*H01H 1/66* (2006.01)
*H01H 36/00* (2006.01)

(56) References Cited

U.S. PATENT DOCUMENTS

| | | | | |
|---|---|---|---|---|
| 2012/0175229 | A1* | 7/2012 | Yang | H01H 1/26 200/1 B |
| 2017/0194119 | A1* | 7/2017 | Jing | H01H 36/0033 |

FOREIGN PATENT DOCUMENTS

| | | | |
|---|---|---|---|
| CN | 101017740 | A | 8/2007 |
| CN | 201017828 | Y | 2/2008 |
| CN | 201490105 | U | 5/2010 |
| CN | 201490106 | U | 5/2010 |
| CN | 102592856 | A | 7/2012 |
| CN | 104217893 | A | 12/2014 |
| CN | 104221115 | A | 12/2014 |
| CN | 104779102 | A | 7/2015 |
| EP | 2474989 | A2 | 7/2012 |
| GB | 1305590 | A | 2/1973 |
| JP | 61195514 | A | 8/1986 |
| JP | 589738 | A | 4/1993 |
| JP | 2007257906 | A | 10/2007 |
| JP | 2009152024 | A | 7/2009 |

* cited by examiner

HEAVY CURRENT REED SWITCH CONTACT STRUCTURE

CROSS-REFERENCE TO RELATED APPLICATIONS

This application is a National Stage Appl. filed under 35 USC 371 of International Patent Application No. PCT/CN2016/076060 with an international filing date of Mar. 10, 2016, designating the United States, now pending, and further claims foreign priority to Chinese Patent Application No. 201510132609.9 filed Mar. 25, 2015. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to a switch contact which is a key component of electrical or electronic switches, and more particularly to a heavy current reed switch contact.

Description of the Related Art

Conventional reed switch contacts are produced according to a simple planar design. When the reed switch contacts are used in a circuit with large loads, for example, where the on/off voltage exceeds 10 V and the current exceeds 0.1 A, an extremely hot and bright conductive gas, i.e., electric arc, is produced in gaps between the contacts. The electric arc seriously erodes the surfaces of the electric contacts, leading to the adhesion of the electric contacts, and even burning down the switch contacts. To improve the make-and-break ability and service life of switches, the chemical structures with different electric contacts are adopted to improve the arc ablation resistance of the electric contacts. In medium-sized and large switches, to reduce the erosion of the electric contacts caused by the electric arcs, arc-extinguishing devices are installed. The common arc-extinguishing methods include the metal grid plate arc-extinguishing method, the magnetic blowout method, the inert gas arc-extinguishing method and the vacuum arc-extinguishing method. Although these arc-extinguishing methods exhibit good arc-extinguishing effect, for some volume-limited small reed switches with compact structure, the arc-extinguishing devices cannot be installed.

At present, small reed switches are mainly used in miniature relays, magnetic reed switches, micro-switches and travel switches. Since the switch contacts of these switches all adopt a common design, they cannot bear large electric charge loads. In practical use, the electric arc erosion leads to the adhesion or breakdown of the electric contacts. The problem is particularly outstanding in the fields of magnetic reed switches, miniature relays and travel switches.

SUMMARY OF THE INVENTION

It is one objective of the invention to provide a heavy current reed switch contact which is simple in structure and can bear large load currents. The reed switch comprises specially designed contacts, and on the basis of conventional switch contacts, an arc discharge device is disposed on the reed switch so as to rapidly transfer electric arcs produced at the on/off moment of the switch contacts to the arc discharge device, thus reducing the surface erosion of the electric contacts, preventing the adhesion of the contacts, and substantially improving the electric current-carrying and on/off ability of the switch.

To achieve the above objectives, in accordance with one embodiment of the invention, there is provided a heavy current reed switch contact, comprising at least one pair of elastic reed electrodes, or at least one fixed electrode and one elastic reed electrode. The reed electrode is of conducting materials, the opposite sides of the overlapped ends of the electrodes comprise contacts, and one end of the elastic reed electrode in the vicinity of the contacts is provided with a protruding arc discharge device. The end surfaces of the reed electrodes overlap, and there is a gap between two electrode contacts if the reed switch is of normally open type. If the reed switch is of normally closed type, the two electrode contacts are in a closed state. If the reed switch is of change-over type, the point electrode and the normally closed electrode are in a closed state and there is a gap between the point electrode and the normally open electrode. The front distance between the contacts and the distance between the side shoulders of the contacts and the shoulders of the arc discharge device are determined by relevant working parameters such as the specific breaking current and voltage and breakdown voltage. The front distance between the contacts in a static break state is larger than the distance between the side shoulder of the contact and the shoulder of the arc discharge device, and the distance between the side shoulder of the contact and the shoulder of the arc discharge device is the maximum distance for the breakdown voltage. The opposite sides of the side shoulders of the electrodes and the side shoulders of the arc discharge device are electroplated with an arc resistant layer.

At the moment when the state of the two electrodes transforms from a closed state to an open state, an electric arc is produced between the two contacts. As the distance between the two contacts increases gradually, when the front distance between the electric contacts increases and is larger than the distance between the side shoulders of the contacts and the shoulders of the arc discharge device, the electric arc transfers to a position between the side shoulders of the contacts and the shoulders of the arc discharge device. As the distance between the two electrodes further increases, the front distance between the contacts and the distance between the side of the contact and the arc discharge device increase simultaneously until the electric arc quenches. Finally, when the front distance of the contacts and the distance between the side of the contact and the arc discharge device reach a maximum value, the two electrodes maintain a final stable state.

Since the transfer time for an electric arc from the surfaces of two contacts to the arc discharge devices at the ends of the two electrodes is extremely short, the continuing combustion of the electric arc happens mostly between the arc discharge devices at the ends of the two electrodes, thus substantially reducing the damage of contact surfaces caused by electric arcs and increasing the electric charge-carrying ability of reed switches.

In combination with the technical proposal of the patent application (a heavy current magnetic reed switch with Chinse Patent Application No. 201410501337.0), the technical proposal of the invention can substantially increase the electric charge carrying ability of magnetic reed switches.

DETAILED DESCRIPTION OF THE EMBODIMENTS

Reed switches are generally divided into three types: the normally open type A, the normally closed type B and the change-over type C.

Example 1

Figure 1:
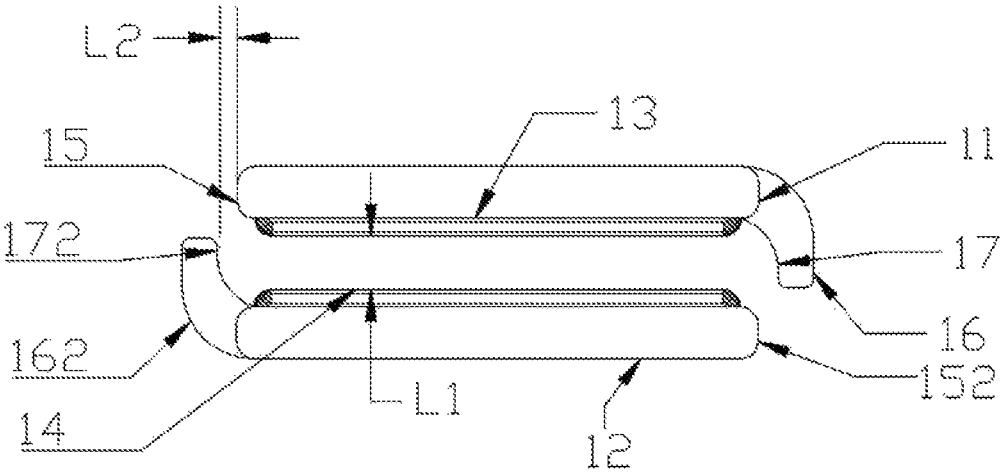
FIG. 1 is a schematic diagram of a heavy current reed switch contact according to Example 1 of the present disclosure.
Figure 1:
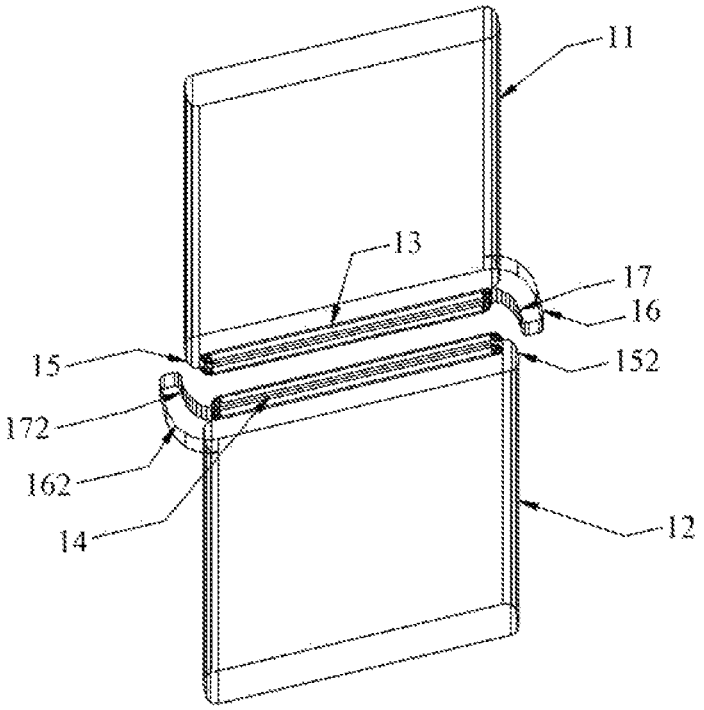

FIG. 1 shows a heavy current reed switch contact, which is a normally open structure. The reed switch contact comprises at least one pair of elastic reed electrodes (11, 12), or at least one fixed electrode (12) and one elastic reed electrode (11). The electrodes (11, 12) are made of conducting materials and the surfaces of one end of the electrodes overlap. The opposite sides of the overlapped ends comprise contacts (13, 14). The end of the reed electrode (11) in the vicinity of the contacts comprises a first protruding arc discharge device (16). The end of the other reed electrode (12) in the vicinity of the contacts comprises a second protruding arc discharge device (162). There is a gap between the reed electrode contacts (13, 14). The front distance (L1) between the electrode contacts (13, 14) and the distance (L2) between the side shoulders (15, 152) of the contacts and the shoulders (17, 172) of the arc discharge device are determined by relevant working parameters such as the specific breaking current and voltage and breakdown voltage. The front distance (L1) between contacts in a static break state is larger than the distance (L2) between the side shoulders (15, 152) of the contacts and the shoulders (17, 172) of the arc discharge device, and the distance (L2) between the side shoulders of the contacts and the shoulders of the arc discharge device is the maximum distance for the breakdown voltage of the switch. The opposite sides of the side shoulders (15, 152) of the electrode and the side shoulders (17, 172) of the arc discharge device are electroplated with an arc resistant layer.

At the moment when the state of the two electrodes (11, 12) transforms from a closed state to an open state, an electric arc is produced between the two contacts (13, 14). As the distance (L1) between the two contacts increases gradually, when the front distance (L1) between the electric contacts (13, 14) increases and is larger than the distance (L2) between the side shoulders (15, 152) of the contacts and the shoulders (17, 172) of the arc discharge device, the electric arc transfers to between the side shoulders (15, 152) of the contacts and the shoulders (17, 172) of the arc discharge device (16, 162). As the distance (L1) between the two electrodes further increases, the front distance (L1) between the contacts and the distance (L2) between the side of the contact and the arc discharge device increase simultaneously until the electric arc quenches. Finally, when the front distance (L1) of the contacts and the distance (L2) between the side of the contact and the arc discharge device maximize, the two electrodes (11, 12) maintain the final stable state.

The transformation process of the two electrodes (11, 12) from an open state to a closed state is the opposite of the open process.

Example 2

Figure 2:
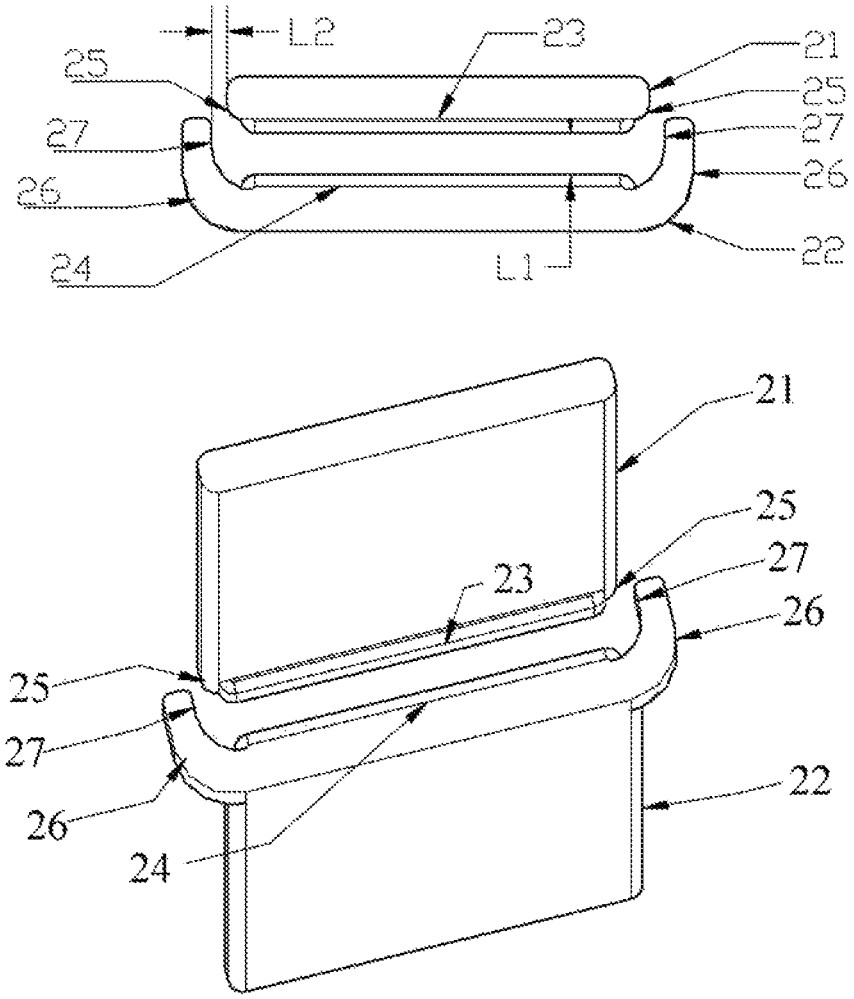
FIG. 2 is a schematic diagram of a heavy current reed switch contact according to Example 2 of the present disclosure.

FIG. 2 shows a heavy current reed switch contact which is a normally open structure. The reed switch contact comprises at least one pair of elastic reed electrodes (21, 22), or at least one fixed electrode (22) and one elastic reed electrode (21). The electrodes (21, 22) are made of conducting materials and the surfaces of one end of the electrodes overlap. The opposite sides of the overlapped ends comprise contracts (23, 24). The end of the reed electrode (22) in the vicinity of the contacts comprises a protruding arc discharge device (26). There is a gap between the reed electrode contacts (23, 24). The front distance (L1) between the electrode contacts (23, 24) and the distance (L2) between the side shoulder (25) of the contact and the shoulder (27) of the arc discharge device are determined by relevant working parameters such as the specific breaking current and voltage and breakdown voltage. The front distance (L1) between contacts in a static break state is larger than the distance (L2) between the side shoulder (25) of the contact and the shoulder (27) of the arc discharge device, and the distance (L2) between the side shoulder of the contact and the shoulder of the arc discharge device is the maximum breakdown voltage distance of the switch. The opposite sides of the side shoulder (25) of the electrode and the side shoulder (27) of the arc discharge device are electroplated with an arc resistant layer.

The transformation process of the two electrodes (21, 22) between a closed state and an open state and the movement process of the electric arc between the contacts are similar to the open and closed processes in Example 1.

Example 3

Figure 3:
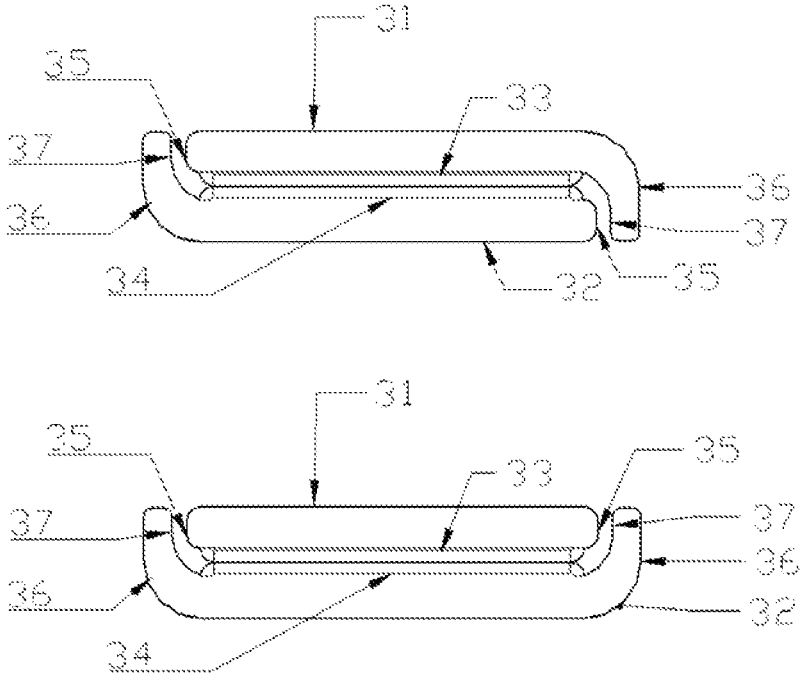
FIG. 3 is a schematic diagram of a heavy current reed switch contact according to Example 3 of the present disclosure.

FIG. 3 shows a heavy current reed switch contact which is a normally closed structure. The reed switch contact comprises at least one pair of elastic reed electrodes (31, 32), or at least one fixed electrode (32, 31) and one elastic reed electrode (31, 32). The reed electrodes (31, 32) are made of conducting materials, and the surfaces of one end of the electrodes overlap. The opposite sides of the overlapped ends comprise contacts (33, 34). The end of the reed electrode (31, 32) in the vicinity of the contacts comprises a protruding arc discharge device (36). The end surfaces of the reed electrode (31, 32) overlap. The two electrode contacts (33, 34) are in a closed state.

The transformation process of the two electrodes (31, 32) between a closed state and an open state and the movement process of the electric arc between the contacts are similar to the open and closed processes in Example 1.

Example 4

Figure 4:
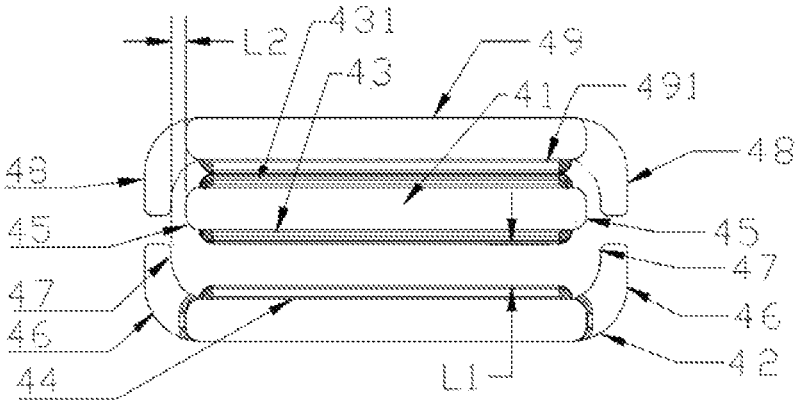
FIG. 4 is a schematic diagram of a heavy current reed switch contact according to Example 4 of the present disclosure.

FIG. 4 shows a heavy current reed switch contact which is a change-over type structure. The reed switch contact comprises at least one pair of elastic reed electrodes (41, 42, 49), or at least one fixed electrode (42, 49) and one elastic reed electrode (41). The fixed electrode or reed electrode is of conducting materials, and the surfaces of one end of the electrodes overlap. The opposite sides of the overlapped ends comprise contacts (43, 44, 431, 491). The ends of the reed electrode or fixed electrode (42, 49) in the vicinity of the contacts comprise protruding arc discharge devices (46, 48). The end surfaces of the reed electrodes (41, 42, 49) overlap. The contacts (431, 491) of the two electrodes (41, 49) are in a closed state. The contacts (43, 44) of the two electrodes (41, 42) are in a normally open state.

The transformation process of the pair of electrodes (41, 42, 49) between a closed state and an open state and the movement process of the electric arc between contacts are similar to the open and closed processes in Example 1.

Example 5

Figure 5:
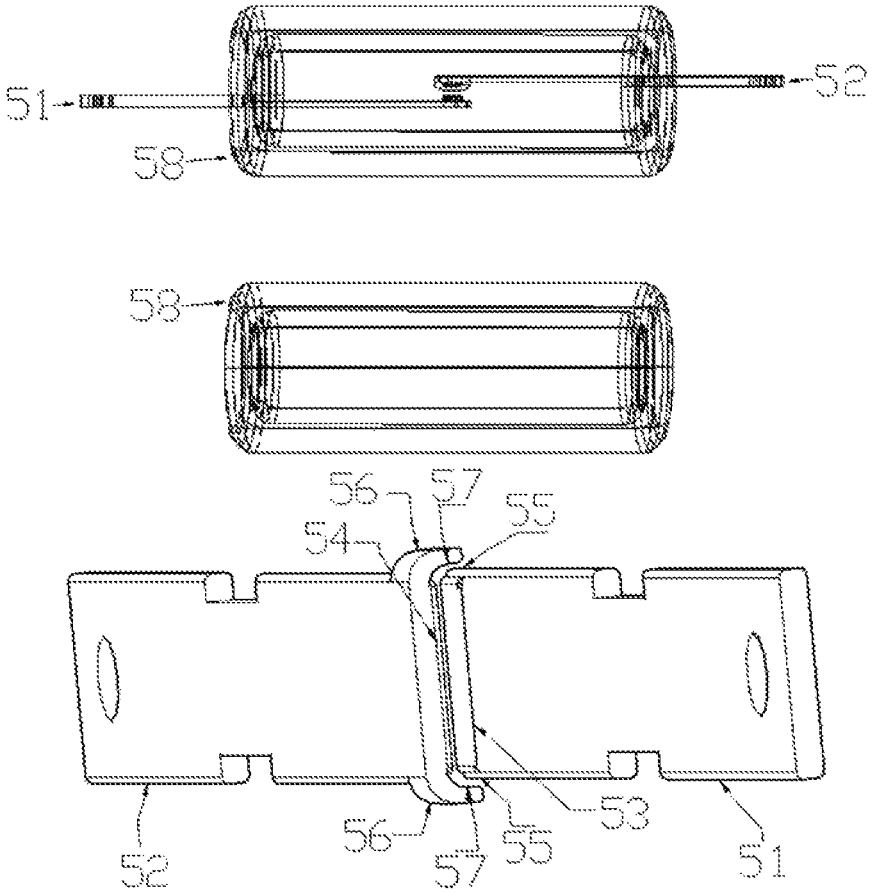
FIG. 5 is a schematic diagram of a heavy current reed switch contact according to Example 5 of the present disclosure.

FIG. 5 shows a heavy current reed switch contact which is applied to a heavy current magnetic reed switch. The reed switch contact comprises a high-strength insulation tube (58) and a pair of elastic reed electrodes (51, 52), or a fixed electrode (52) and an elastic reed electrode (51). The insulation tube (58) is filled with inert gas. The reed electrodes (51, 52) are made of conducting materials with excellent magnetic conductivity. The surfaces of one end of the electrodes overlap. The opposite sides of the overlapped ends comprise contacts (53, 54). The end of the reed electrode (52) in the vicinity of the contact comprises a protruding arc discharge device (56). If the magnetic reed switch is a normally open type, there is a gap between the electrode contacts (53, 54). If the magnetic switch is a change-over type, the point electrode and the normally closed electrode are in a closed state, there is a gap between the point electrode and the normally open electrode, and the reed structure is similar to Example 4.

Under the polarization of magnetic fields and the circumstance of removing magnetic fields, the closed and open processes between all electrodes of the magnetic reed switch and the movement process of the electric arc between the contacts are similar to that in Example 1.

Example 6

Figure 6:
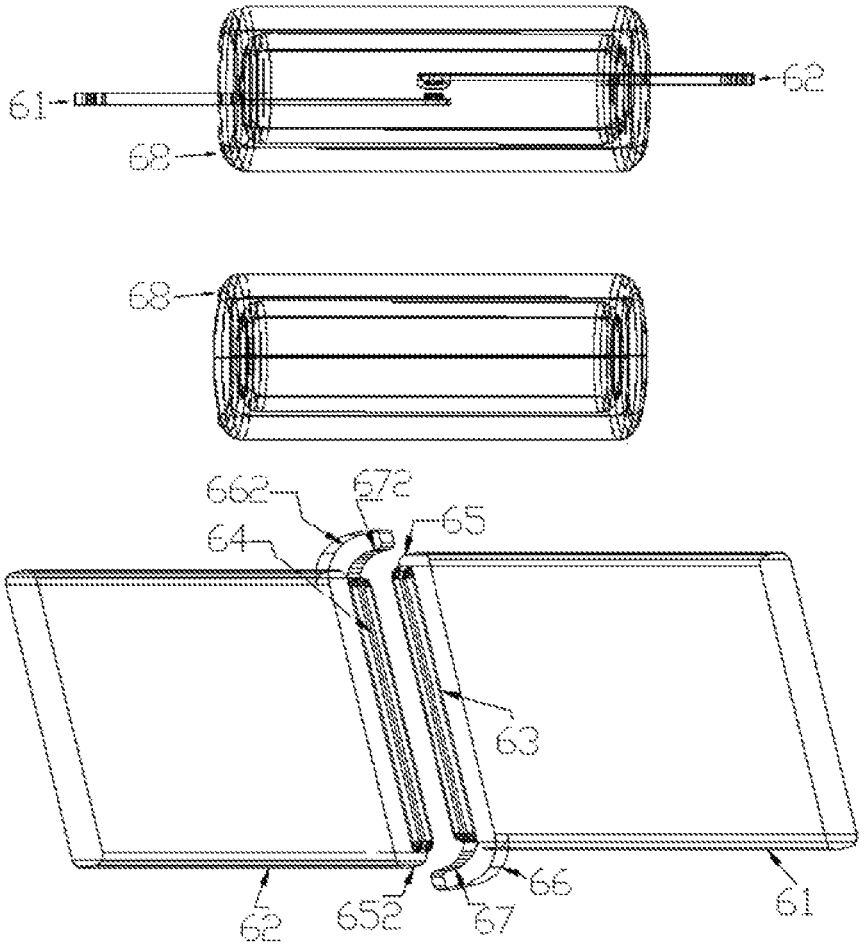
FIG. 6 is a schematic diagram of a heavy current reed switch contact according to Example 6 of the present disclosure.

FIG. 6 shows a heavy current reed switch contact which is applied to a heavy current magnetic reed switch. The reed switch contact comprises a high-strength insulation tube (68) and a pair of elastic reed electrodes (61, 62), or a fixed electrode (62) and an elastic reed electrode (61). The insulation tube is filled with inert gas. The reed electrodes (61, 62) are made of conducting materials with excellent magnetic conductivity. The surfaces of one end of the electrodes overlap. The opposite sides of the overlapped ends comprise contacts (63, 64). The end of the reed electrode (62) in the vicinity of the contacts comprises a protruding arc discharge device (662). The end of the reed electrode (61) in the vicinity of the contacts comprises a protruding arc discharge device (66). If the magnetic reed switch is a normally open type, there is a gap between the electrode contacts (63, 64). If the magnetic switch is a change-over type, the point electrode and the normally closed electrode are in a closed state, there is a gap between the point electrode and the normally open electrode, and the reed structure is similar to Example 4.

Under the polarization of magnetic fields and the circumstance of removing magnetic fields, the closed and open processes between all electrodes of the magnetic reed switch and the movement process of the electric arc between the contacts are similar to that in Example 1.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A reed switch contact, comprising two reed electrodes, a first arc discharge device, and a second arc discharge device; each of said two reed electrodes comprising a first sheet surface, a second sheet surface, a first edge, a second edge, and a contact;

wherein:

at least one of said two reed electrodes is elastic;

said two electrodes are made of conducting material, and each of said two reed electrodes is in a sheet shape;

said first sheet surfaces of said two reed electrodes are faced with each other;

in each of said two reed electrodes:

said first sheet surface and said second sheet surface are opposite to each other;

said first edge and said second edge are disposed between said first sheet surface and said second sheet surface, and are substantially parallel to each other; and said contact is disposed on said first sheet surface, and said contact extends along a direction that is substantially perpendicular to said first edge and said second edge;

said first edges of said two reed electrodes are adjacent to each other, and said second edges of said two reed electrodes are adjacent to each other;

said contacts of said two reed electrodes are substantially parallel to each other;

there is a first distance between said contacts of said two reed electrodes along a transversal direction that is perpendicular to said contacts of said two reed electrodes;

said first arc discharge device is disposed on said first edge of one of said two reed electrodes and in the vicinity of said contact of said one of said two reed electrodes, and extends toward said first edge of the other of said two reed electrodes;

said second arc discharge device is disposed on said second edge of one of said two reed electrodes and in the vicinity of said contact of said one of said two reed electrodes, and extends toward said second edge of the other of said two reed electrodes;

said first edge and said second edge of each of said two reed electrodes are disposed between said first arc discharge device and said second arc discharge device along a longitudinal direction that is parallel to said contacts of said two reed electrodes;

there is a second distance along the longitudinal direction between said first arc discharge device and said first edge toward which said first arc discharge device extends;

there is the second distance along the longitudinal direction between said second arc discharge device and said second edge toward which said second arc discharge device extends;

when the reed switch contact is in an off state, the first distance is equal to a distance L1, the second distance is equal to a distance L2, and the distance L2 is smaller than the distance L1;

said first arc discharge device and said second arc discharge device are configured to receive an electric arc produced at an on/off moment of the reed switch contact; and at the on/off moment of the reed switch contact, when the first distance is larger than the second distance, said contacts of said two reed electrodes are not subjected to the electric arc, and said first arc discharge device and said second arc discharge device are subjected to the electric arc.

2. The reed switch contact of claim 1, wherein said first arc discharge device and said first edge toward which said first arc discharge device extends comprise areas that are faced with each other and that are electroplated with an arc resistant layer; and said second arc discharge device and said second edge toward which said second arc discharge device extends comprise areas that are faced with each other and that are electroplated with an arc resistant layer.

3. The reed switch contact of claim 1, wherein the distance L1 and the distance L2 are determined according to relevant working parameters of the reed switch contact comprising a breaking current, a breaking voltage, and a breakdown voltage; determines the breakdown voltage.

* * * * *